US005588322A

United States Patent [19]

Passone

[11] Patent Number: 5,588,322

[45] Date of Patent: Dec. 31, 1996

[54] UNIVERSAL SUPPORT AND POSITIONING STRUCTURE FOR TOOLS USED BY AN ELONGATE ELEMENT BENDING MACHINE

[75] Inventor: Carlo Passone, Vinovo, Italy

[73] Assignee: Bending Tooling S.R.L., Vinovo, Italy

[21] Appl. No.: 313,299

[22] PCT Filed: Apr. 2, 1993

[86] PCT No.: PCT/EP93/00813

§ 371 Date: Dec. 7, 1994

§ 102(e) Date: Dec. 7, 1994

[87] PCT Pub. No.: WO93/19864

PCT Pub. Date: Oct. 14, 1993

[30] Foreign Application Priority Data

Apr. 6, 1992 [IT] Italy ..... TO92A0313

[51] Int. Cl.[6] ..... B21D 7/02

[52] U.S. Cl. ..... 72/383; 72/298; 72/387

[58] Field of Search ..... 72/303, 306, 298, 72/310, 387, 388, 383

[56] References Cited

U.S. PATENT DOCUMENTS

| | | | |
|---|---|---|---|
| 1,462,315 | 7/1923 | Akey et al. | 72/383 |
| 2,884,987 | 5/1959 | Shaw | 72/383 |
| 4,351,178 | 9/1982 | Uehara | 72/383 |

FOREIGN PATENT DOCUMENTS

| | | | |
|---|---|---|---|
| 1264229 | 5/1961 | France | 72/383 |
| 1378361 | 10/1964 | France . | |
| 4214205 | 11/1993 | Germany | 72/306 |

*Primary Examiner*—David Jones
*Attorney, Agent, or Firm*—Rothwell, Figg Ernst & Kurz

[57] ABSTRACT

A universal positioning and support structure for tools usable by a machine for bending elongated elements such as tubes or profiled sections, includes at least one base body and a support platform for the tools. The support platform is movably mounted on the base body. The platform is capable of rotating circumferentially and for contemporaneously being displaced radially with respect to a pivot fixed to the base body.

14 Claims, 4 Drawing Sheets

UNIVERSAL SUPPORT AND POSITIONING STRUCTURE FOR TOOLS USED BY AN ELONGATE ELEMENT BENDING MACHINE

The present invention relates to a support and positioning structure for tools used by a machine for bending elongate elements such as tubes or profiled sections.

Known structures of the type indicated are designed for well defined applications and therefore have the disadvantage that they cannot be adapted for use in bending elements different from those originally intended.

The object of the present invention is that of providing a structure of the type indicated above which is adapted for use in positioning and supporting various tools used for bending elongate elements of widely varying forms, thereby obtaining apparatus which is not excessively complex and which operates simply and with wide versatility in use.

This object is achieved with a structure of the type indicated above, characterised by the fact that it includes at least one base body and a support platform for said tools movably mounted on the base body and provided with means for rotating it circumferentially and for contemporaneously displacing it radially with respect to a pivot fixed to the base body.

Preferably, said base body and support platform form part of a slide movably mounted on a support frame, means being provided for moving the slide relative to this latter in at least one direction.

More preferably the structure according to the invention comprises two slides movably mounted on a single support frame and each comprising a respective base body and a respective support platform.

Before use of the machine for bending elongate elements into a desired configuration the slides are conveniently positioned with respect to the frame by their associated movement-drive means. Then the tools required by the type of bending which it is intended to effect are positioned on the support platforms of the slides. Subsequently the bending operation itself is effected by a suitable combined translational and rotational movement of the support platforms about their respective pivots.

In practice, the rotational movement allows the desired curvature to be obtained, whilst the translational movement, which takes place contemporaneously with the rotational movement, causes the curved element to yield so that it can no longer reassume its original, undeformed configuration as a result of the elastic restoring forces, once the bending stress has been released.

The present invention also comprehends a machine for bending elongate elements including a tool support and positioning structure of the type indicated above.

Advantages and characteristics of the present invention will become apparent from the following detailed description made with reference to the appended drawings, provided by way of non-limitative example, in which.

Figure 1:
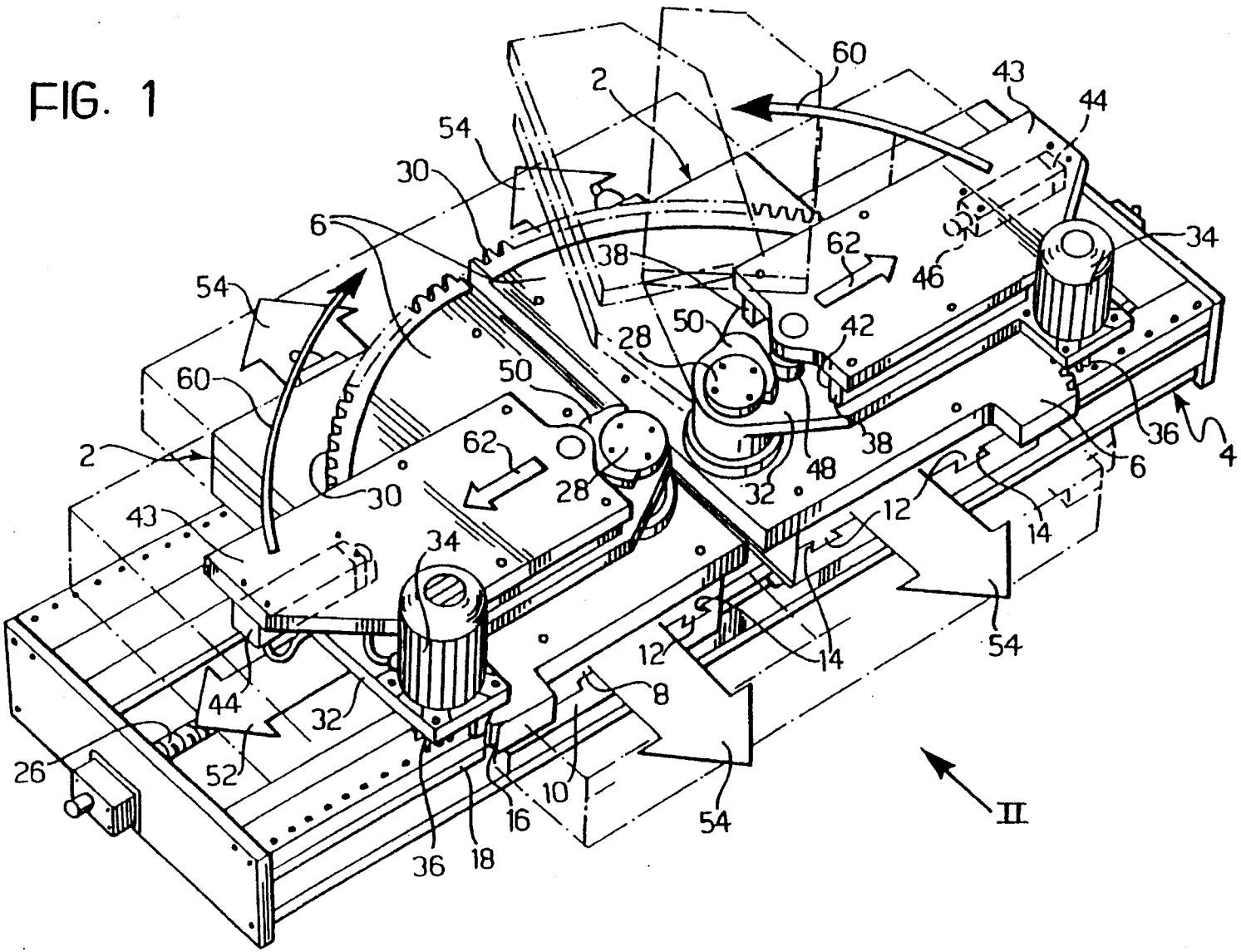
FIG. 1 is a perspective view of the structure of the invention.

A universal support and positioning structure for tools used by a bending machine (FIGS. 1 to 3) includes a pair of slides 2 slidably mounted on a support frame 4.

Each slide 2 comprises a flat base body 6 connected to a first plate 8 slidable on a second plate 10 by means of a pair of projections 12 which fit into respective grooves 14 formed in the second plate 10.

This latter is in turn slidable on the frame 4 by means of a pair of terminal coupling elements 16 which engage respective guides 18 of the frame 4.

Fixed to each first plate 8 is a first feed nut 20 associated with a first lead screw 22 extending transverse the frame. Similarly, each second plate 10 has a second feed nut 24 fixed thereto and associated with a second lead screw 26 mounted to lie along the longitudinal axis of the frame 2, substantially perpendicular to the first screw 22.

The base body 6 of each slide 2 supports a pin 28 and carries a rack 30, shaped in the manner of a circumferential arc on a portion of its outer perimeter. A table 32 is rotatable about each pin 28 and supports a hydraulic motor 34 which drives a pinion 36 which meshes with the respective rack 30. Each table 32 further supports a pair of guide elements 38 on which protuberances 42 which project downwardly from a respective support platform 43 are slidably retained. Each of these latter is fixed to an actuator cylinder 44 having a piston 46 the free end of which is fixed to the associated table 32.

Furthermore, a cam follower roller 48 projects downwardly from each support platform 43 and cooperates with a shaped cam-element 50 keyed to the respective pin 28.

The operation of the device is as follows.

Depending on the type of elongate element which it is intended to bend and the curvature which it is intended to impart thereto, the base bodies 6 of the two slides 2 are positioned relative to the frame 4 by translational movement in two orthogonal directions. For this purpose the second screws 26 are rotated and cooperate with the second feed nuts 24 which cause the second plates 10 to move longitudinally, these carrying the first-plates 8 mounted thereon with them in their movement (this movement is indicated by the arrows 52 in FIGS. 1 and 3).

Figure 3:
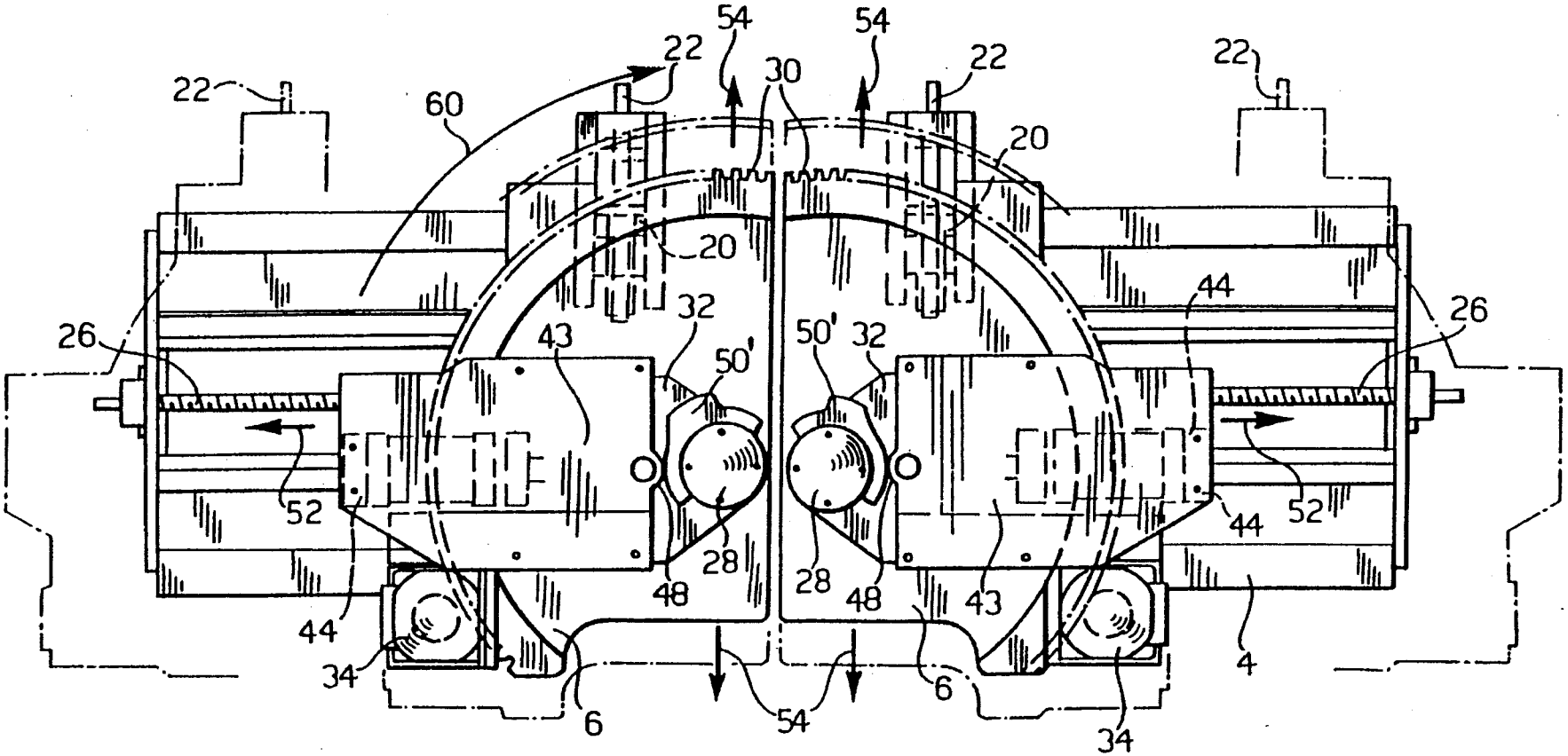
FIG. 3 is a plan view of the structure of the invention.

The turning of the first screws 22, which cooperate with the first feed nuts 20, then drives a transverse translational movement of the first plate 8 relative to the frame 4, with the definitive positioning of the base bodies 6 with respect to the frame (this movement, orthogonal to that indicated by the arrows 52, is indicated by the arrows 54 in FIGS. 1 and 3).

Figure 4:
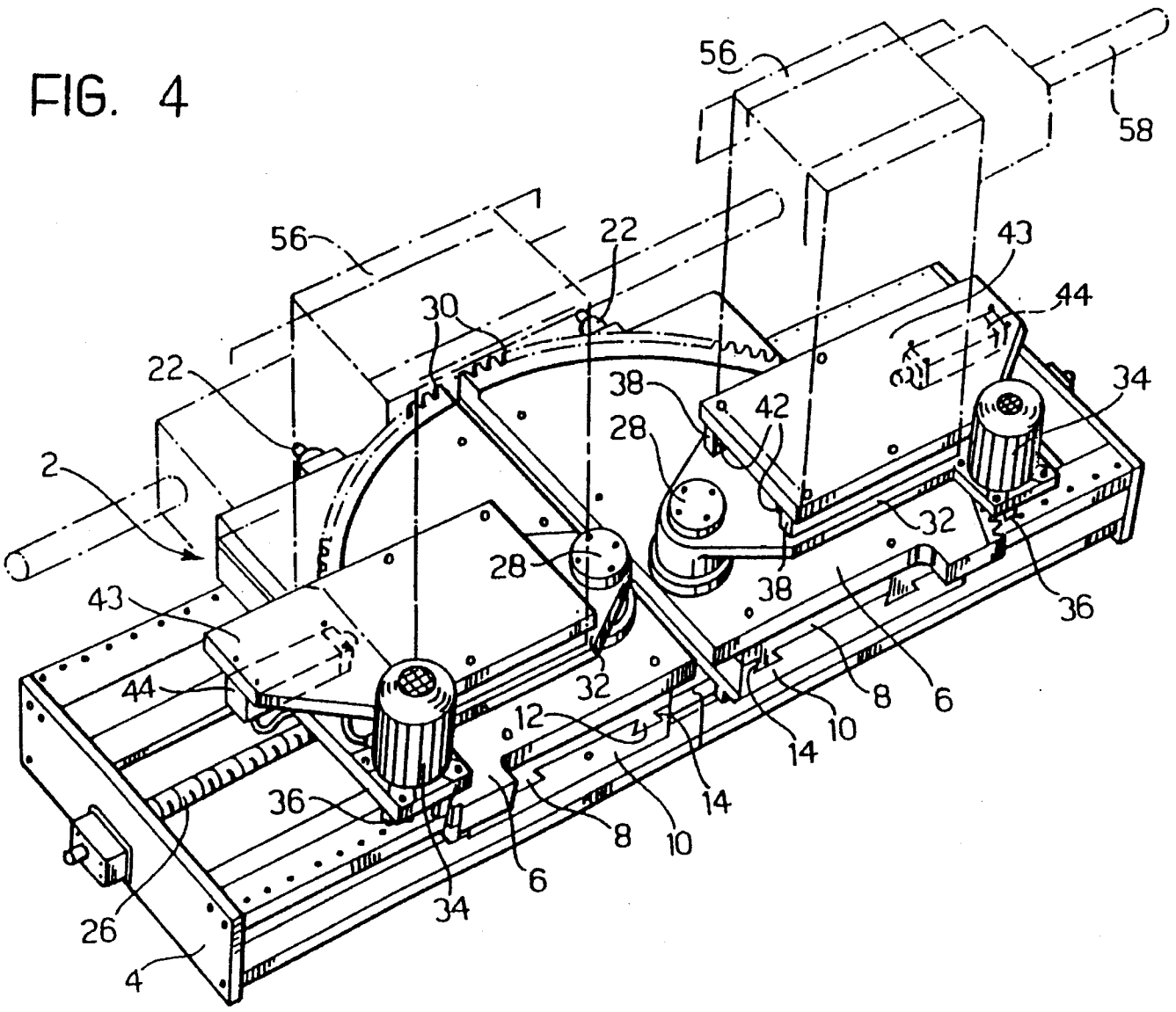
FIG. 4 is a perspective view of a bending machine which utilises a structure of the type illustrated in the preceding figures.

At this point the tools 56 necessary to support and clamp the elongate elements 58 during the bending operation itself are positioned in a known manner on the support planes 43 of the slides 2 (FIG. 4).

The bending operation takes place thanks to a combined translational and rotational movement of the platforms 43, which support the tools 56 and the elongate elements 58, with respect to the pins 28.

In fact, the rotation allows the desired curvature to be obtained whilst the translation, which takes place simultaneously with the rotation, causes the curved element 58 to yield so that it can no longer reassume its original, undeformed configuration as a result of the resilient restoring forces once the bending stress has been released.

The rotation of the platforms 43 about the pins 28 (indicated by the arrows 60 in FIGS. 1 and 3) is driven by the hydraulic motors 34 which, by rotating the respective pinions 36 which mesh with the associated racks 30, cause the associated tables 32 which carry the support platform 43 to rotate about the pins 28.

The radial translational movement of the platforms 43 with respect to the pins 28 (indicated by the arrows 62 in FIG. 1) takes place simultaneously with the rotation thanks to the action of the actuator cylinders 44 or to the engagement existing between the cam follower rollers 48 and the shaped cam elements 50 keyed to the pins 28.

The coordination and control of the rotational and translational movements is achieved by an apparatus control computer, not illustrated in the drawings, to which the individual actuator devices are connected in a manner known per se.

Figure 2:
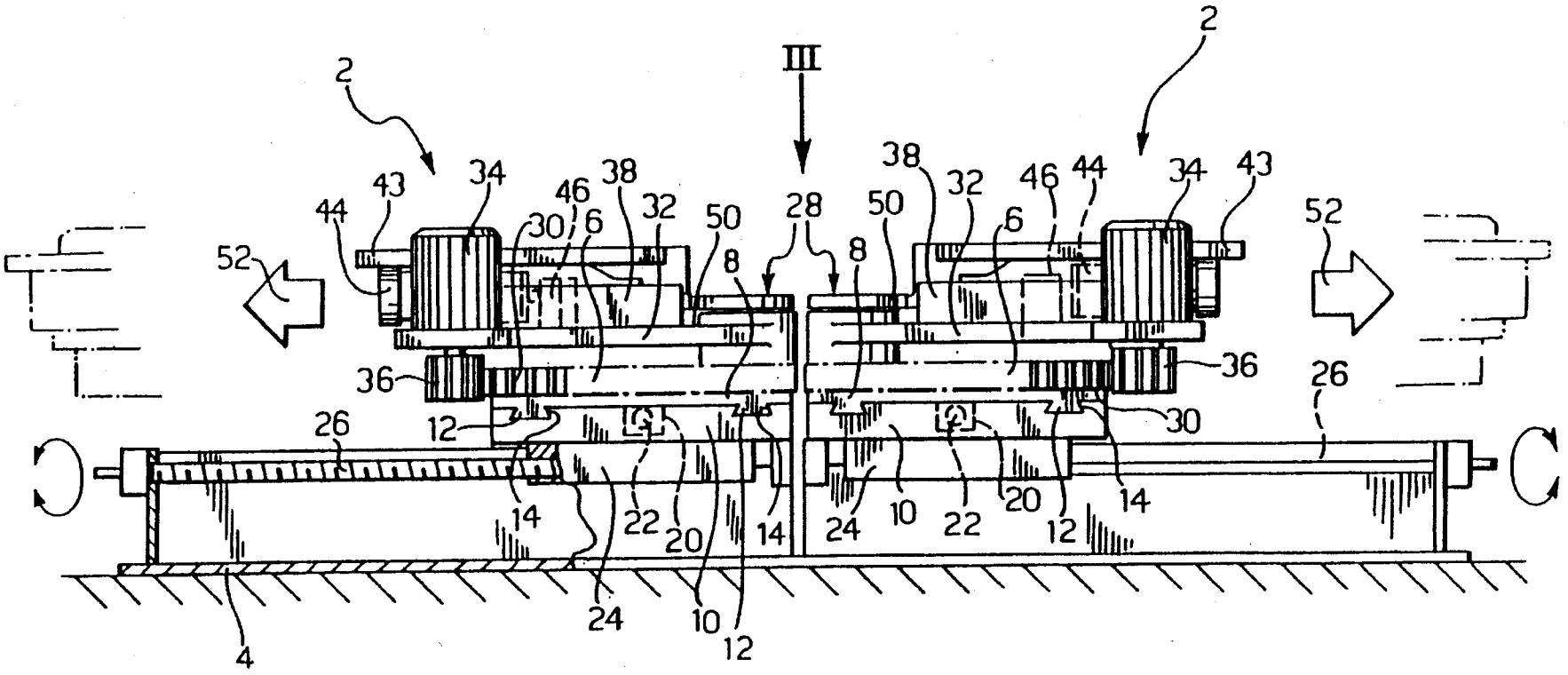
FIG. 2 is a side view of the structure of the invention.

FIGS. 1 to 3 of the appended drawings illustrate both types of device for enabling the radial translation mounted on the same machine. Obviously, in practice, use will be made of only one of these depending on the specific applicational requirements. In fact, the cam and cam follower roller device is more economical but requires longer to be adapted to a different bending process, whilst the actuator cylinder system (illustrated only in FIG. 4) is more expensive but more rapidly adaptable to different uses.

The versatility of the apparatus of the invention is evident from what has been described above in that, by simple adjustment of the screws 22, 26 and feed nuts 20, 24, the position of the base bodies 6 of the slides 2 with respect to the frame 4 can be adjusted and by making the support platforms 43 perform different translational and rotational movements with respect to the pins 28 one can obtain the most varied bending shapes.

Naturally, the principle of the invention remaining the same, the details of construction and the embodiments can be widely varied with respect to what has been described and illustrated without thereby departing from the scope of the present invention.

For example, the apparatus of the invention may include a single slide movable on the support frame. Such apparatus is adapted to bending elongate elements, which can be clamped between a vice not mounted on the support structure and tools supported by the support platform of the single slide, into shapes which are not excessively complicated.

I claim:

1. A universal support and positioning structure for tools useable by a machine for clamping and bending elongate elements such as tubes or profiled sections, including at least one base body and a support platform for said tools movably mounted on the base body and provided with means for rotating the support platform circumferentially with respect to a pivot fixed to the base body and characterized in that it further includes means for displacing the support platform radially with respect to the pivot contemporaneously to its rotation.

2. A structure according to claim 1, further comprising a support frame and a slide movably mounted on said support frame, said slide including said base body and said support platform, said structure further including means for moving the slide relative to the frame in at least one direction.

3. A structure according to claim 2, characterized by the fact that it includes two slides movably mounted on said support frame and each including a respective base body and a respective support platform.

4. A structure according to claim 3, wherein said slides are each provided with means for displacing them relative to said frame in two different directions.

5. A structure according to claim 4, wherein each of said means for displacing said slides relative to the frame comprises a first plate connected to said base body, a first feed nut fixed to said first plate and associated with a first lead screw mounted on the frame, a second plate slidably coupled to the first plate, a second feed nut fixed to said second plate and associated with a second lead screw, said second plate also slidably coupled to said support frame and being slidable on the support frame in a direction substantially perpendicular to the direction of sliding of the first plate relative to the second plate.

6. A structure according to claim 5, wherein for each of said means for displacing said slides relative to the frame the first plate includes a pair of projections, said second plate includes respective grooves in which said projections engage, and the second plate further includes a pair of terminal coupling elements and the frame includes respective guides with which said terminal coupling elements engage.

7. A structure according to claim 4, further including for each support platform a means for rotating the support platform circumferentially with respect to the pivot, and each said means including a table rotatable about the pivot and on which is located the support platform, a hydraulic motor located on said table, a pinion driven by said hydraulic motor, and a rack engagable with said pinion, said rack shaped in the form of a circumferential arc and carried by the base body to which the pivot is fixed.

8. A structure according to claim 7, further including means for displacing each support platform radially with respect to its respective pivot, said means comprising a cam follower roller which projects from the support platform, a cam-shaped element keyed to the pivot, said cam-shaped element arranged to cooperate with said cam follower roller, a pair of protuberances extending from said platform, and guide elements fixed to the table, said pair of protuberances engaging with said guide elements, whereby said platform is slidable relative to the table.

9. A structure according to claim 2, characterized by the fact that said slide is provided with means for displacing it relative to the frame in two different directions.

10. A structure according to claim 9, characterized by the fact that said means for displacing the slide relative to the frame comprises a first plate connected to said base body, a first feed nut fixed to said first plate and associated with a first lead screw mounted on the frame, a second plate slidably coupled to the first plate, a second feed nut fixed to said second plate and associated with a second lead screw, said second plate also slidably coupled to said support frame and being slidable on the support frame in a direction substantially perpendicular to the direction of sliding of the first plate relative to the second plate.

11. A structure according to claim 10, wherein the first plate includes a pair of projections, said second plate includes respective grooves in which said projections engage, and the second plate further includes a pair of terminal coupling elements and the frame includes respective guides with which said terminal coupling elements engage.

12. A structure according to claim 9, characterized by the fact that said means for rotating the support platform circumferentially with respect to the pivot includes a table rotatable about the pivot and on which is located the support platform, a hydraulic motor located on said table, a pinion driven by said hydraulic motor, and a rack engagable with said pinion, said rack shaped in the form of a circumferential arc and carried by the base body to which the pivot is fixed.

13. A structure according to claim 12, characterized by the fact that said means for displacing the support platform radially with respect to the pivot comprises a cam-shaped element keyed to the pivot, a cam follower roller which projects from the support platform, said cam-shaped element arranged to cooperate with said cam follower roller, a pair of protuberances extending from said platform, and guide elements fixed to the table, said pair of protuberances engaging with said guide elements, whereby said platform is slidable relative to the table.

14. A structure according to claim 12, characterized by the fact that said means for displacing the support platform radially with respect to the pivot comprises an actuator cylinder mounted on the support platform and having a piston with a free end, the free end being fixed to the table, guide elements fixed to the table, said support platform being slidable relative to the table by means of a pair of protuberances which engage with said guide elements.

* * * * *